US009545133B1

(12) United States Patent
Wu

(10) Patent No.: US 9,545,133 B1
(45) Date of Patent: Jan. 17, 2017

(54) SAFETY BELT BUCKLE FOR RACE CAR

(71) Applicant: TAIWAN RACING PRODUCTS CO., LTD., Hemei Township, Changhua County (TW)

(72) Inventor: Wen-Yuan Wu, Dacun Township (TW)

(73) Assignee: Taiwan Racing Products Co., Ltd., Hemei Township (TW)

( * ) Notice: Subject to any disclaimer, the term of this patent is extended or adjusted under 35 U.S.C. 154(b) by 0 days.

(21) Appl. No.: 15/203,297

(22) Filed: Jul. 6, 2016

(51) Int. Cl.
*A44B 11/25* (2006.01)

(52) U.S. Cl.
CPC ..... *A44B 11/2542* (2013.01); *A44B 11/2549* (2013.01); *A44B 11/2561* (2013.01)

(58) Field of Classification Search
CPC ..... A44B 11/2542; A44B 11/2549; A44B 11/2561; A44B 11/2569; Y10T 24/45618; Y10T 24/45623
See application file for complete search history.

(56) References Cited

U.S. PATENT DOCUMENTS 2,391,204 A * 12/1945 Turner ..... B64D 17/32 24/579.11
2,416,757 A * 3/1947 Johnston ..... B64D 17/32 24/579.11
2,430,341 A * 11/1947 Johnston ..... B64D 17/32 24/579.11
2,641,813 A * 6/1953 Loxham ..... B64D 17/32 24/573.11
3,703,749 A * 11/1972 Pfabe ..... B64D 17/32 24/579.11
3,747,167 A * 7/1973 Pravaz ..... A44B 11/2542 24/573.11
3,825,979 A * 7/1974 Jakob ..... A44B 11/2534 24/579.11
4,610,058 A * 9/1986 Stemmildt ..... B64D 17/32 24/579.11
4,656,700 A * 4/1987 Tanaka ..... A44B 11/2542 24/579.11
4,813,111 A * 3/1989 Nohren ..... B64D 17/32 24/573.11
7,065,843 B1 * 6/2006 Wu ..... A44B 11/2542 24/631
2005/0086778 A1 * 4/2005 Gastaldi ..... A44B 11/2542 24/633
2011/0010901 A1 * 1/2011 Holler ..... A44B 11/2542 24/593.1
2015/0181985 A1 * 7/2015 Norbert ..... A44B 11/2542 24/632

* cited by examiner

*Primary Examiner* — Robert J Sandy
*Assistant Examiner* — David Upchurch
(74) *Attorney, Agent, or Firm* — Alan D. Kamrath; Kamrath IP Lawfirm, P.A.

(57) ABSTRACT

A safety belt buckle includes a base unit, a cover covering and combined with the base unit, a locking device mounted in the cover, a torsion spring mounted on the cover, and a driving unit mounted on the cover. When in use, a latch plate of a safety belt is inserted into one of the insertion slots of the base unit. Thus, the user has to apply a determined force to overcome the elastic force of the torsion spring and to drive the driving unit so as to release the latch plate of the safety belt, thereby preventing the driving unit from being driven freely by an external force due to an unintentional touch or hit, and thereby preventing the latch plate of the safety belt from being unlatched easily.

9 Claims, 10 Drawing Sheets

SAFETY BELT BUCKLE FOR RACE CAR

BACKGROUND OF THE INVENTION

1. Field of the Invention

The present invention relates to a safety belt buckle and, more particularly, to a safety belt buckle for a race car.

2. Description of the Related Art

A conventional safety belt buckle for a race car comprises a main body, a rotary drive member and a fastening member. The main body has a periphery provided with a plurality of insertion slots and has a top having a center provided with a post which is provided with a square drive portion which is provided with a screw hole. The top of the main body is provided with a limit block located beside the post. A locking device is mounted in the main body and is controlled by rotation of the post. The rotary drive member includes a circular disk and a drive handle extending from the circular disk. The circular disk has a top having a center provided with a circular recess which has a face provided with a square mounting hole. The circular disk has a bottom provided with an arcuate limit slot located beside the square mounting hole. In assembly, when the rotary drive member is mounted on the main body, the square mounting hole of the rotary drive member is mounted on the square drive portion of the post of the main body, and the arcuate limit slot of the rotary drive member is mounted on the limit block of the main body. The fastening member is screwed into the screw hole of the post of the main body so that the rotary drive member is combined with the post of the main body. When in use, a latch plate of a safety belt is inserted into one of the insertion slots of the main body and is locked by the locking device. When the rotary drive member is rotated, the post of the main body is rotated to drive the locking device so as to unlock the latch plate of the safety belt from the locking device and to release the latch plate of the safety belt. At this time, the arcuate limit slot of the rotary drive member and the limit block of the main body limit the rotation angle of the rotary drive member. However, rotation of the rotary drive member directly drives and rotates the post of the main body so that when the rotary drive member is driven by an external force due to an unintentional touch or hit, the latch plate of the safety belt will be unlatched and released easily, thereby causing danger to the user.

BRIEF SUMMARY OF THE INVENTION

The primary objective of the present invention is to provide a safety belt buckle that cannot be unlocked easily and freely.

In accordance with the present invention, there is provided a safety belt buckle comprising a base unit, a cover covering and combined with the base unit, a locking device mounted in the cover, a torsion spring mounted on the cover, and a driving unit mounted on the cover. The base unit includes a support base having a top provided with a plurality of slideways, and a plurality of elastic modules mounted in the slideways. The top of the support base has a center provided with a recessed flange. The support base is provided with a plurality of abutting pieces surrounding the recessed flange. The support base has a periphery provided with a plurality of spacing blocks and a plurality of insertion slots located between the spacing blocks. The cover has a top having a center provided with a tube and a bottom provided with a receiving space connected to the tube. The cover is provided with a limit block surrounding the tube. The limit block of the cover has a top provided with a limit boss. The receiving space of the cover is provided with a plurality of convex portions, a plurality of concave portions located between the convex portions, and a plurality of pillars located in the concave portions. The locking device is mounted in the receiving space of the cover and includes a fixed post mounted on one of the pillars of the cover, a plurality of movable posts mounted on the pillars of the cover and corresponding to the elastic modules of the base unit, a plurality of springs mounted on the pillars of the cover and located in the fixed post and the movable posts, a conical spring mounted in the receiving space of the cover, a driven plate mounted in the receiving space of the cover and abutting the conical spring, a rotation shaft mounted on the cover, and a fixed disk arranged under the driven plate and abutting the spacing blocks of the support base. The driven plate of the locking device has a central portion provided with a through hole and a hollow lug and has a rim provided with a plurality of clamping grooves for clamping the movable posts. The hollow lug of the driven plate has a notch. The rotation shaft of the locking device includes a shaft shank extending through the through hole of the driven plate and provided with a pivot hole, and a pin extending through the pivot hole of the shaft shank and abutting the hollow lug of the driven plate. The fixed disk of the locking device has a central portion provided with a retaining hole to allow insertion of the abutting pieces of the support base. The fixed disk of the locking device has a periphery provided with a plurality of passages corresponding to the slideways of the support base. The fixed post and the movable posts of the locking device extend through the passages of the fixed disk. The conical spring of the locking device abuts a top of the receiving space of the cover. The driving unit includes a circular cap and a drive handle extending from the circular cap. The circular cap of the driving unit has a bottom provided with a receiving chamber for covering the tube, the limit block and the torsion spring. The receiving chamber of the circular cap has a periphery provided with a limit wall. The circular cap of the driving unit has a top provided with a fixing hole secured on the rotation shaft of the locking device, and a limit slot for receiving the limit boss of the limit block of the cover. The fixing hole and the limit slot of the circular cap are connected to the receiving chamber. The torsion spring is mounted on the tube of the cover and has two ends abutting two ends of the limit block of the cover and abutting two ends of the limit wall of the circular cap.

According to the primary advantage of the present invention, the user has to apply a determined force to overcome the elastic force of the torsion spring and to drive the driving unit so as to release the latch plate of the safety belt, thereby preventing the driving unit from being driven freely by an external force due to an unintentional touch or hit, and thereby preventing the latch plate of the safety belt from being unlatched easily, so as to protect the user's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
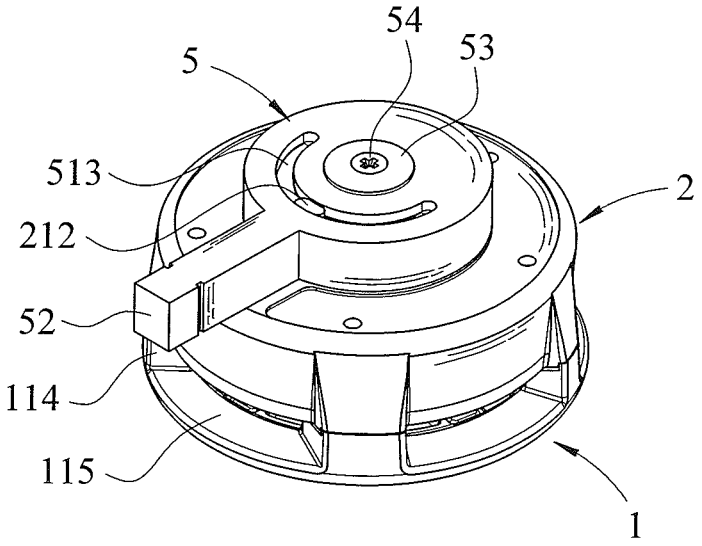
FIG. 1 is a perspective view of a safety belt buckle in accordance with the preferred embodiment of the present invention.
Figure 2:
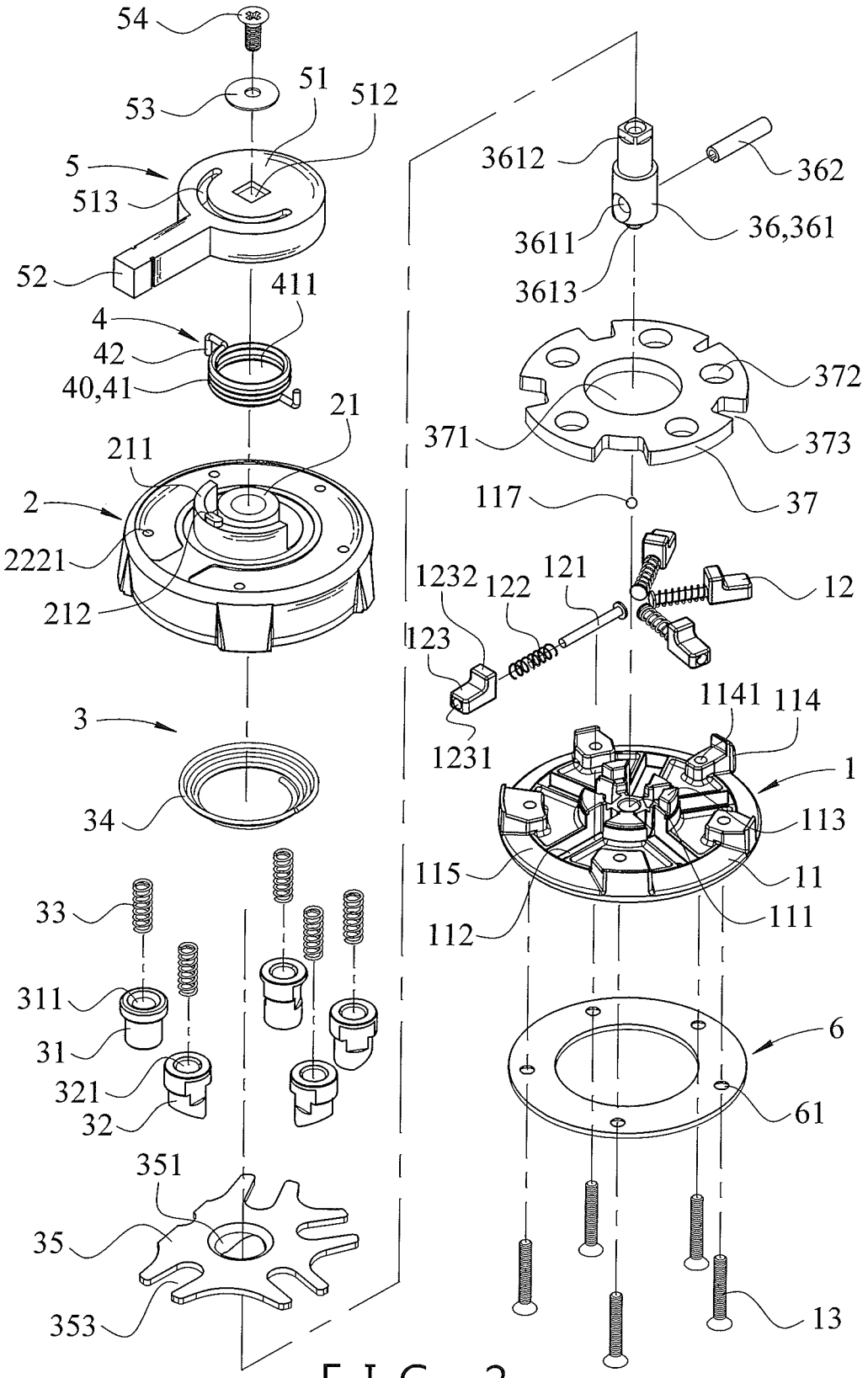
FIG. 2 is an exploded perspective view of the safety belt buckle as shown in FIG. 1.
Figure 3:
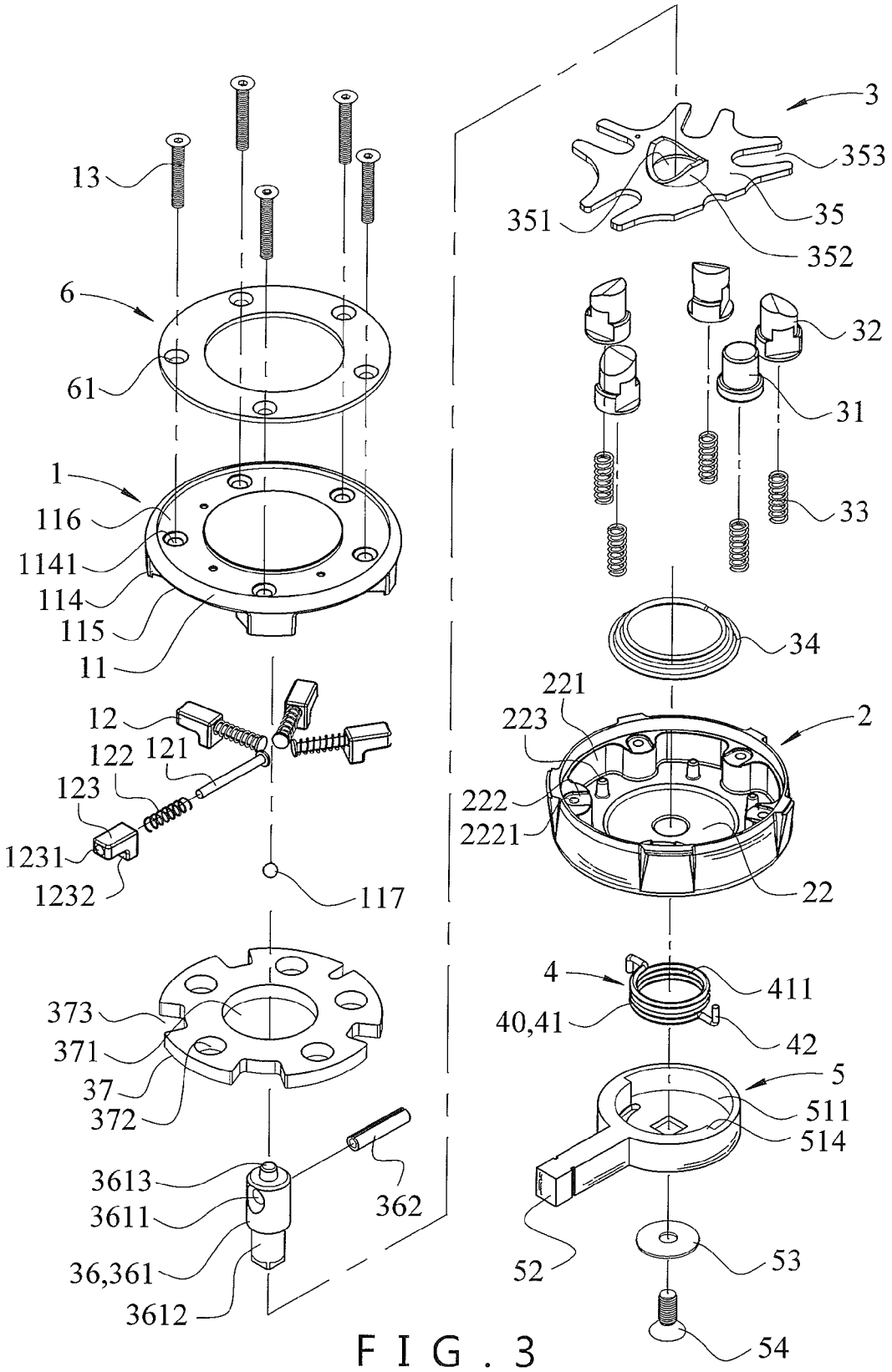
FIG. 3 is another exploded perspective view of the safety belt buckle as shown in FIG. 1.
Figure 4:
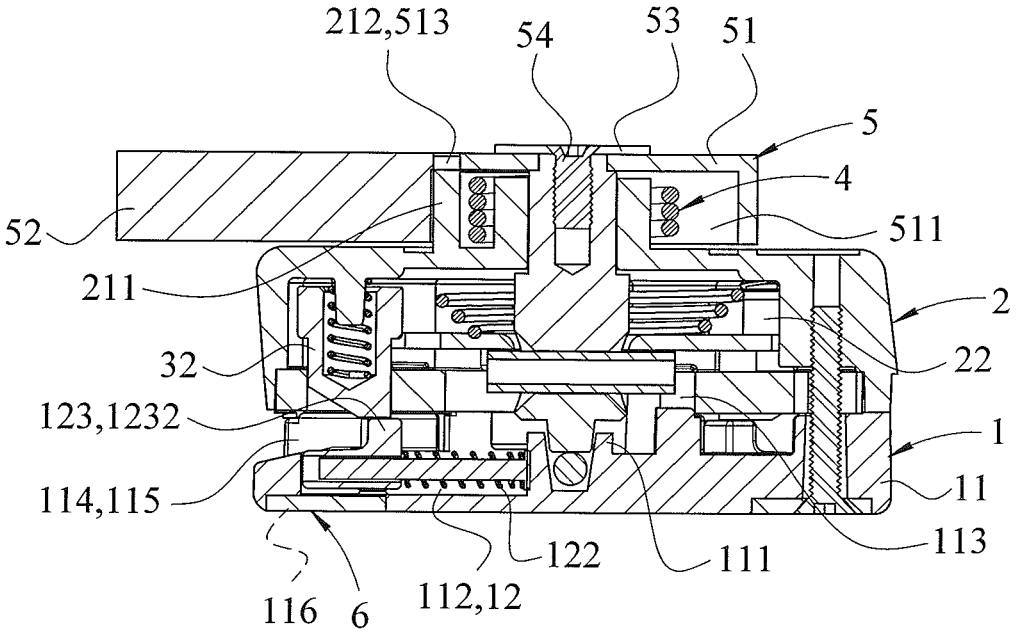
FIG. 4 is a cross-sectional view of the safety belt buckle as shown in FIG. 1.

Referring to the drawings and initially to FIGS. 1-4, a safety belt buckle in accordance with the preferred embodiment of the present invention comprises a base unit 1, a cover 2 covering and combined with the base unit 1, a locking device 3 mounted in the cover 2, a torsion spring 4 mounted on the cover 2, and a driving unit 5 mounted on the cover 2.

The base unit 1 includes a support base 11 having a top provided with a plurality of slideways 112, and a plurality of elastic modules 12 mounted in the slideways 112. The top of the support base 11 has a center provided with a recessed flange 111, and each of the slideways 112 extends from the recessed flange 111 to a periphery of the support base 11. The slideways 112 of the support base 11 are arranged in a radiating manner. The support base 11 is provided with a plurality of abutting pieces 113 surrounding the recessed flange 111 and arranged in a circular manner. The periphery of the support base 11 is provided with a plurality of spacing blocks 114 and a plurality of insertion slots 115 located between the spacing blocks 114. The spacing blocks 114 of the support base 11 are arranged in a radiating manner.

The cover 2 has a top having a center provided with a tube 21 and a bottom provided with a receiving space 22 connected to the tube 21. The cover 2 is provided with a limit block 211 surrounding the tube 21. The limit block 211 of the cover 2 has a semi-circular shape and has a top provided with a limit boss 212. The receiving space 22 of the cover 2 is provided with a plurality of convex portions 222, a plurality of concave portions 221 located between the convex portions 222, and a plurality of pillars 223 located in the concave portions 221. Thus, the receiving space 22 of the cover 2 presents a star-shaped profile.

The locking device 3 is mounted in the receiving space 22 of the cover 2 and includes a fixed post 31 mounted on one of the pillars 223 of the cover 2, a plurality of movable posts 32 mounted on the pillars 223 of the cover 2 and corresponding to the elastic modules 12 of the base unit 1, a plurality of springs 33 mounted on the pillars 223 of the cover 2 and located in the fixed post 31 and the movable posts 32, a conical spring 34 mounted in the receiving space 22 of the cover 2 and corresponding to the tube 21 of the cover 2, a driven plate 35 mounted in the receiving space 22 of the cover 2 and abutting the conical spring 34, a rotation shaft 36 mounted on the cover 2, and a fixed disk 37 arranged under the driven plate 35 and abutting the spacing blocks 114 of the support base 11.

The driven plate 35 of the locking device 3 has a central portion provided with a through hole 351 and a hollow lug 352 and has a rim provided with a plurality of clamping grooves 353 for clamping the movable posts 32. The hollow lug 352 of the driven plate 35 has a notch. The rotation shaft 36 of the locking device 3 includes a shaft shank 361 extending through the through hole 351 of the driven plate 35 and provided with a pivot hole 3611, and a pin 362 extending through the pivot hole 3611 of the shaft shank 361 and abutting the hollow lug 352 of the driven plate 35. The fixed disk 37 of the locking device 3 has a central portion provided with a retaining hole 371 to allow insertion of the abutting pieces 113 of the support base 11 so as to position the fixed disk 37. The fixed disk 37 of the locking device 3 has a periphery provided with a plurality of passages 372 corresponding to the slideways 112 of the support base 11. The fixed disk 37 of the locking device 3 has a rim provided with a plurality of openings 373. The fixed post 31 and the movable posts 32 of the locking device 3 extend through the passages 372 of the fixed disk 37. The fixed post 31 of the locking device 3 has an end provided with an interior hole 311 for mounting one of the springs 33. Each of the movable posts 32 of the locking device 3 has an end provided with an interior hole 321 for mounting one of the springs 33. The conical spring 34 of the locking device 3 abuts a top of the receiving space 22 of the cover 2.

The driving unit 5 includes a circular cap 51 and a drive handle 52 extending from the circular cap 51. The circular cap 51 of the driving unit 5 has a bottom provided with a receiving chamber 511 for covering the tube 21, the limit block 211 and the torsion spring 4. The receiving chamber 511 of the circular cap 51 has a periphery provided with a limit wall 514 abutting the limit block 211 of the cover 2. The limit wall 514 of the circular cap 51 extends inward and has a semi-circular shape. The circular cap 51 of the driving unit 5 has a top provided with a fixing hole 512 secured on the rotation shaft 36 of the locking device 3, and a limit slot 513 for receiving and limiting the limit boss 212 of the limit block 211 of the cover 2. The fixing hole 512 and the limit slot 513 of the circular cap 51 are connected to the receiving chamber 511. The limit slot 513 of the circular cap 51 has an arcuate shape.

The torsion spring 4 is mounted on the tube 21 of the cover 2 and has two ends abutting two ends of the limit block 211 of the cover 2 and abutting two ends of the limit wall 514 of the circular cap 51.

In the preferred embodiment of the present invention, the support base 11 has five slideways 112, the base unit 1 includes four elastic modules 12, and the locking device 3 includes four movable posts 32.

In the preferred embodiment of the present invention, the support base 11 has a bottom provided with an annular groove 116, and the safety belt buckle further comprises an annular plate 6 mounted in the annular groove 116 of the support base 11.

In the preferred embodiment of the present invention, the base unit 1, the annular plate 6 and the cover 2 are combined by screwing. Each of the spacing blocks 114 of the support base 11 is provided with a first bore 1141, the annular plate 6 is provided with a plurality of second bores 61, each of the convex portions 222 of the cover 2 is provided with a locking bore 2221, and the safety belt buckle further comprises a plurality of fastener members 13 each extending through each of the second bores 61 of the annular plate 6 and the first bore 1141 of each of the spacing blocks 114, and each screwed into the locking bore 2221 of each of the convex portions 222.

In the preferred embodiment of the present invention, the base unit 1, the cover 2, the driving unit 5 and the annular plate 6 are made of metallic material that is selected from any one of copper, stainless steel, aluminum, zinc or iron. Thus, the annular plate 6 can enhance the whole strength of the base unit 1.

In the preferred embodiment of the present invention, each of the elastic modules 12 of the base unit 1 includes a support rod 121, a slide 123 mounted on the support rod 121 and having a side provided with a stop 1232 abutting one of the movable posts 32, and a tensile spring 122 mounted on the support rod 121 and biased between the support rod 121 and the slide 123. The slide 123 of each of the elastic modules 12 is provided with an aperture 1231 mounted on the support rod 121.

In the preferred embodiment of the present invention, the fixing hole 512 of the circular cap 51 is mounted on and combined with a top of the shaft shank 361 of the rotation shaft 36 by a locking member 54 which extends through a washer 53 and the fixing hole 512 of the circular cap 51 and is screwed into the shaft shank 361 of the rotation shaft 36. The top of the shaft shank 361 is provided with a positioning stud 3612 secured in the fixing hole 512 of the circular cap 51 to allow screwing of the locking member 54. The shaft shank 361 of the rotation shaft 36 has a bottom provided with an abutting stub 3613 inserted into the recessed flange 111 of the support base 11. Preferably, the positioning stud 3612 of the shaft shank 361 has a square shape, and the fixing hole 512 of the circular cap 51 also has a square shape. The base unit 1 further includes a ball 117 received in the recessed flange 111 of the support base 11 and located between the recessed flange 111 of the support base 11 and the abutting stub 3613 of the shaft shank 361.

In the preferred embodiment of the present invention, the torsion spring 4 is provided with a hollow portion 411 mounted on the tube 21 of the cover 2. The torsion spring 4 is made of a wire 40 which is wound successively to form a helical torque portion 41. The torque portion 41 of the torsion spring 4 is provided with two resting sections 42 abutting the two ends of the limit block 211 of the cover 2 and abutting the two ends of the limit wall 514 of the circular cap 51.

Figure 5:
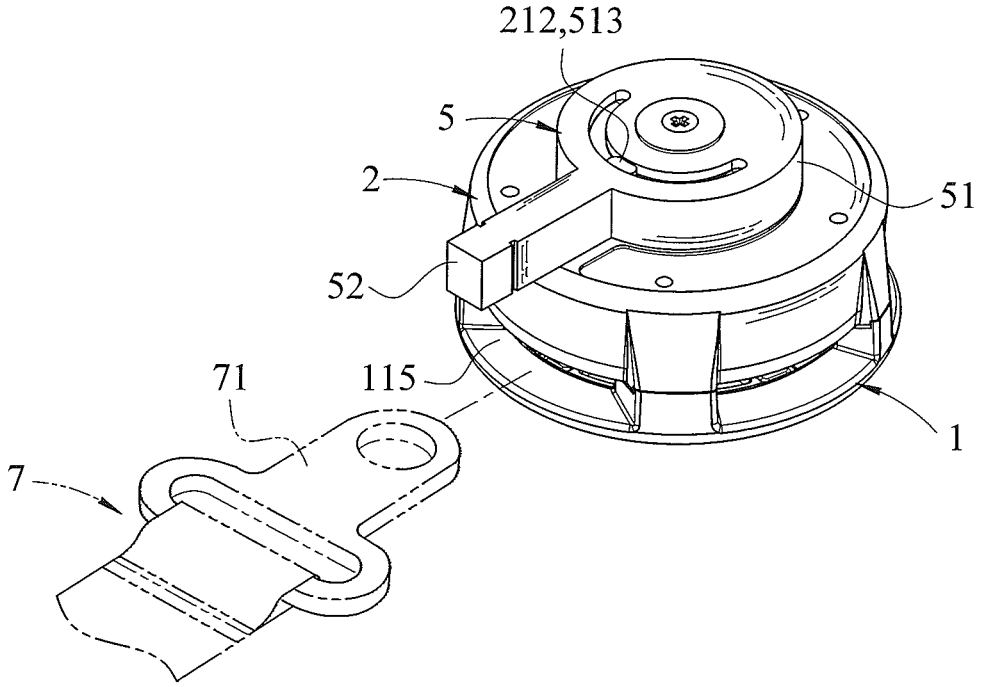
FIG. 5 is a schematic operational view of the safety belt buckle for a safety belt as shown in FIG. 1 in use.
Figure 6:
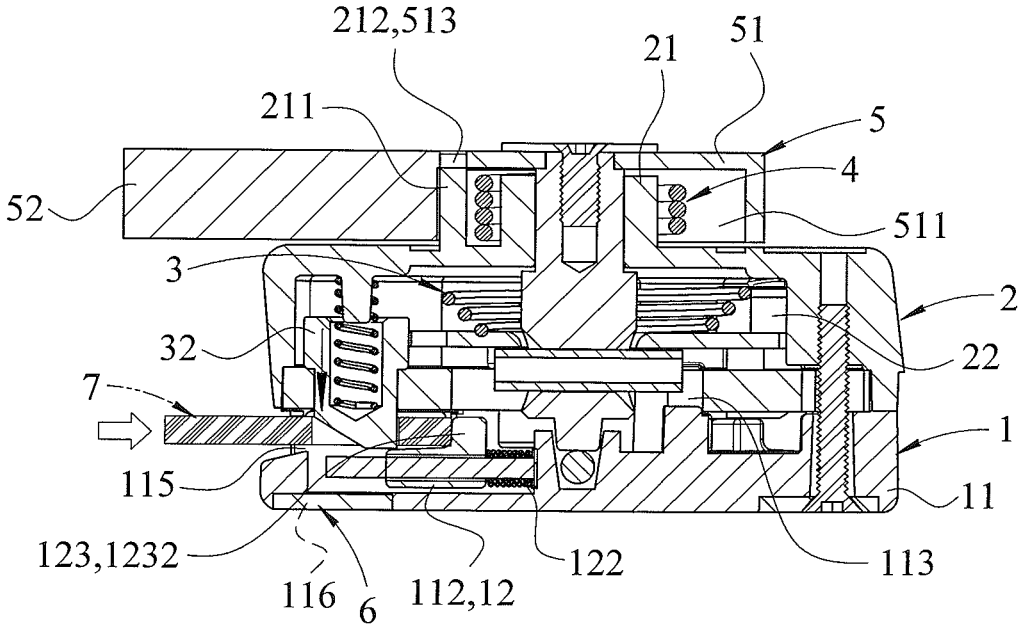
FIG. 6 is a schematic operational view of the safety belt buckle for a safety belt as shown in FIG. 4 in use.
Figure 7:
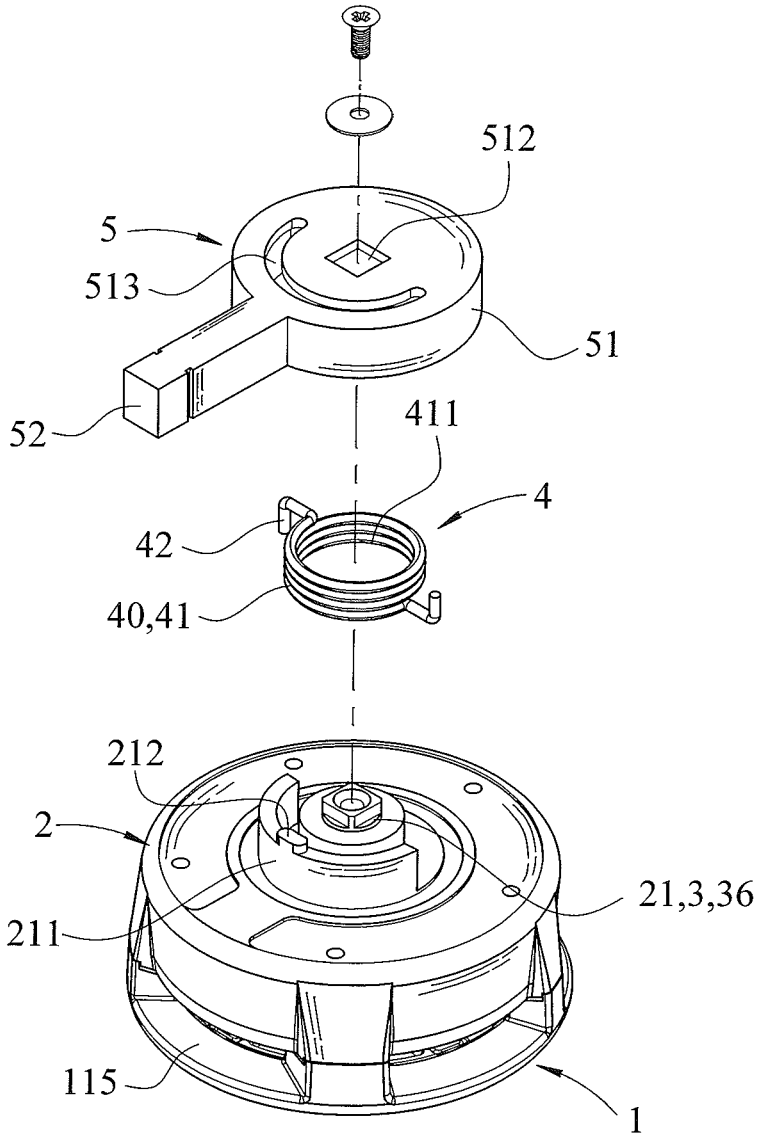
FIG. 7 is a partially exploded perspective view of the safety belt buckle as shown in FIG. 1.
Figure 8:
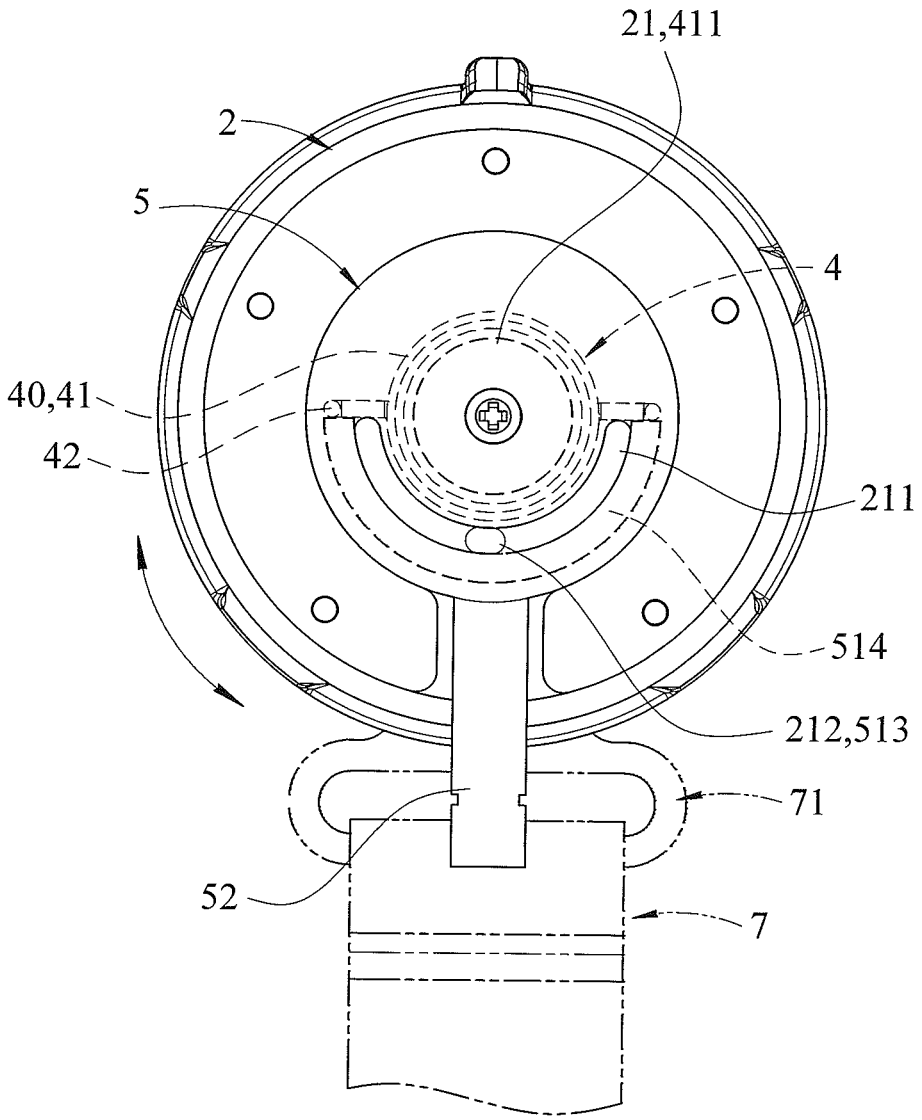
FIG. 8 is a top assembly view of the safety belt buckle for a safety belt as shown in FIG. 5.
Figure 9:
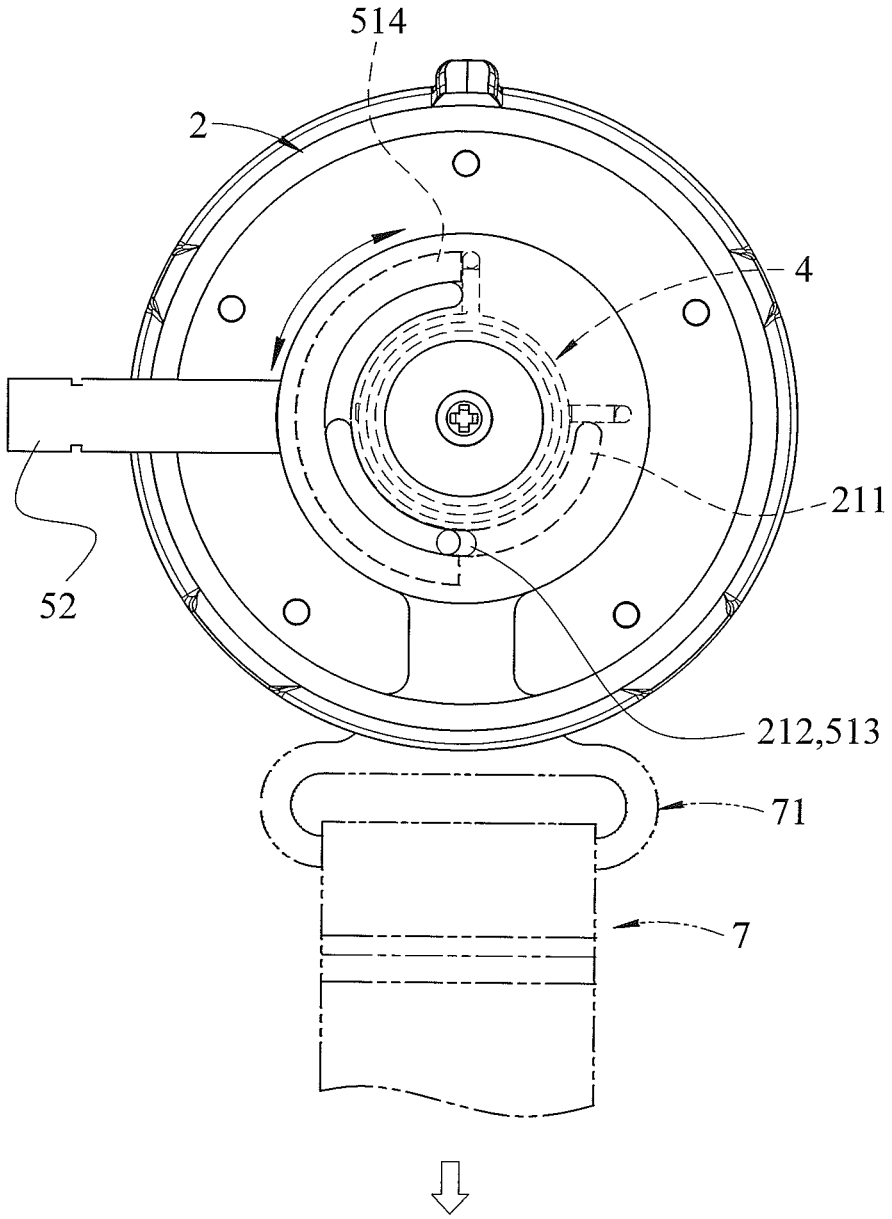
FIG. 9 is a schematic operational view of the safety belt buckle for a safety belt as shown in FIG. 8 in use.
Figure 10:
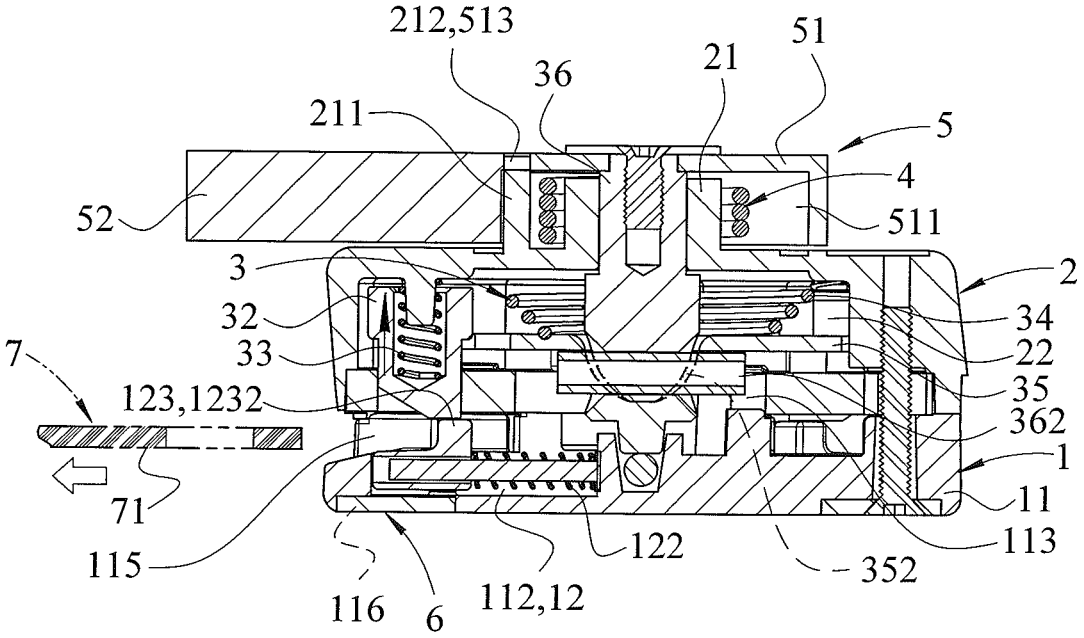
FIG. 10 is a schematic operational view of the safety belt buckle for a safety belt as shown in FIG. 6.

In operation, referring to FIGS. 8-10 with reference to FIGS. 1-7, when a latch plate 71 of a safety belt 7 is inserted into one of the insertion slots 115 of the base unit 1 as shown in FIG. 5, the stop 1232 of the slide 123 of one of the elastic modules 12 is pushed by the latch plate 71 of the safety belt 7 to compress the tensile spring 122, so that the slide 123 is moved inward in one of the slideways 112 of the support base 11. In such a manner, one of the movable posts 32 of the locking device 3 is released from the stop 1232 of the slide 123 and is pushed downward by the restoring force of one of the springs 33 to lock a hole (not labeled) of the latch plate 71, so that the latch plate 71 of the safety belt 7 is locked by one of the movable posts 32 of the locking device 3 and retained by the slide 123 of one of the elastic modules 12 as shown in FIG. 6.

On the contrary, when the drive handle 52 of the driving unit 5 is driven, the circular cap 51 of the driving unit 5 is rotated to spin the rotation shaft 36 of the locking device 3. At this time, the pin 362 of the rotation shaft 36 initially abuts the notch of the hollow lug 352 of the driven plate 35. When the rotation shaft 36 of the locking device 3 is rotated, the pin 362 of the rotation shaft 36 is moved toward an edge of the hollow lug 352 to push the driven plate 35 upward and to compress the conical spring 34, so that each of the movable posts 32 of the locking device 3 is moved upward by the driven plate 35 to release the latch plate 71 of the safety belt 7, and each of the springs 33 is compressed. In such a manner, after the latch plate 71 of the safety belt 7 is unlocked from one of the movable posts 32 of the locking device 3, the latch plate 71 of the safety belt 7 and the slide 123 of one of the elastic modules 12 are pushed outward by the restoring force of the tensile spring 122, so that the latch plate 71 of the safety belt 7 is detached from one of the insertion slots 115 of the base unit 1 as shown in FIG. 10.

After the latch plate 71 of the safety belt 7 is released from the base unit 1, the driven plate 35 is pushed by the restoring force of the conical spring 34 to return to the original position, the slide 123 of one of the elastic modules 12 is pushed by the restoring force of the tensile spring 122 to return to the original position, and the movable posts 32 are pushed by the restoring force of the springs 33 to return to the original position, so that the stop 1232 of the slide 123 of one of the elastic modules 12 presses one of the movable posts 32 again, and the rotation shaft 36 and the driving unit 5 are driven to rotate reversely to the original position.

It is to be noted that, the two resting sections 42 of the torque portion 41 of the torsion spring 4 abut the two ends of the limit block 211 of the cover 2 and abut the two ends of the limit wall 514 of the circular cap 51 so that the torsion spring 4 is biased between the circular cap 51 of the driving unit 5 and the limit block 211 of the cover 2. In such a manner, when the circular cap 51 of the driving unit 5 is rotated relative to the limit block 211 of the cover 2, the torsion spring 4 provides a resistance to the circular cap 51 of the driving unit 5, so that the user has to apply a larger force to overcome the elastic force of the torsion spring 4 so as to rotate the circular cap 51 of the driving unit 5 and to release the latch plate 71 of the safety belt 7. At this time, the limit slot 513 of the circular cap 51 guides and limits movement of the limit boss 212 of the limit block 211 of the cover 2 as shown in FIGS. 8 and 9.

Accordingly, the user has to apply a determined force to overcome the elastic force of the torsion spring 4 and to drive the driving unit 5 so as to release the latch plate 71 of the safety belt 7, thereby preventing the driving unit 5 from being driven freely by an external force due to an unintentional touch or hit, and thereby preventing the latch plate 71 of the safety belt 7 from being unlatched easily, so as to protect the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A safety belt buckle comprising:

a base unit;

a cover covering and combined with the base unit;

a locking device mounted in the cover;

a torsion spring mounted on the cover; and a driving unit mounted on the cover;

wherein:

the base unit includes:

a support base having a top provided with a plurality of slideways; and a plurality of elastic modules mounted in the slideways;

the top of the support base has a center provided with a recessed flange;

the support base is provided with a plurality of abutting pieces surrounding the recessed flange;

the support base has a periphery provided with a plurality of spacing blocks and a plurality of insertion slots located between the spacing blocks;

the cover has a top having a center provided with a tube and a bottom provided with a receiving space connected to the tube;

the cover is provided with a limit block surrounding the tube;

the limit block of the cover has a top provided with a limit boss;

the receiving space of the cover is provided with a plurality of convex portions, a plurality of concave portions located between the convex portions, and a plurality of pillars located in the concave portions;

the locking device is mounted in the receiving space of the cover and includes:

a fixed post mounted on one of the pillars of the cover;

a plurality of movable posts mounted on the pillars of the cover and corresponding to the elastic modules of the base unit;

a plurality of springs mounted on the pillars of the cover and located in the fixed post and the movable posts;

a conical spring mounted in the receiving space of the cover;

a driven plate mounted in the receiving space of the cover and abutting the conical spring, a rotation shaft mounted on the cover; and a fixed disk arranged under the driven plate and abutting the spacing blocks of the support base;

the driven plate of the locking device has a central portion provided with a through hole and a hollow lug and has a rim provided with a plurality of clamping grooves for clamping the movable posts;

the hollow lug of the driven plate has a notch;

the rotation shaft of the locking device includes a shaft shank extending through the through hole of the driven plate and provided with a pivot hole, and a pin extending through the pivot hole of the shaft shank and abutting the hollow lug of the driven plate;

the fixed disk of the locking device has a central portion provided with a retaining hole to allow insertion of the abutting pieces of the support base;

the fixed disk of the locking device has a periphery provided with a plurality of passages corresponding to the slideways of the support base;

the fixed post and the movable posts of the locking device extend through the passages of the fixed disk;

the conical spring of the locking device abuts a top of the receiving space of the cover;

the driving unit includes a circular cap and a drive handle extending from the circular cap;

the circular cap of the driving unit has a bottom provided with a receiving chamber for covering the tube, the limit block and the torsion spring;

the receiving chamber of the circular cap has a periphery provided with a limit wall;

the circular cap of the driving unit has a top provided with a fixing hole secured on the rotation shaft of the locking device, and a limit slot for receiving the limit boss of the limit block of the cover;

the fixing hole and the limit slot of the circular cap are connected to the receiving chamber; and the torsion spring is mounted on the tube of the cover and has two ends abutting two ends of the limit block of the cover and abutting two ends of the limit wall of the circular cap.

2. The safety belt buckle of claim 1, wherein:

the torsion spring is provided with a hollow portion mounted on the tube of the cover;

the torsion spring is made of a wire which is wound successively to form a helical torque portion; and the torque portion of the torsion spring is provided with two resting sections abutting the two ends of the limit block of the cover and abutting the two ends of the limit wall of the circular cap.

3. The safety belt buckle of claim 1, wherein the support base has a bottom provided with an annular groove, and the safety belt buckle further comprises an annular plate mounted in the annular groove of the support base.

4. The safety belt buckle of claim 3, wherein each of the spacing blocks of the support base is provided with a first bore, the annular plate is provided with a plurality of second bores, each of the convex portions of the cover is provided with a locking bore, and the safety belt buckle further comprises a plurality of fastener members each extending through each of the second bores of the annular plate and the first bore of each of the spacing blocks, and each screwed into the locking bore of each of the convex portions.

5. The safety belt buckle of claim 1, wherein:

each of the elastic modules of the base unit includes:

a support rod;

a slide mounted on the support rod and having a side provided with a stop abutting one of the movable posts; and a tensile spring mounted on the support rod and biased between the support rod and the slide; and the slide of each of the elastic modules is provided with an aperture mounted on the support rod.

6. The safety belt buckle of claim 1, wherein the fixing hole of the circular cap is mounted on and combined with a top of the shaft shank of the rotation shaft by a locking member which extends through a washer and the fixing hole of the circular cap and is screwed into the shaft shank of the rotation shaft.

7. The safety belt buckle of claim 6, wherein the top of the shaft shank is provided with a positioning stud secured in the fixing hole of the circular cap to allow screwing of the locking member.

8. The safety belt buckle of claim 7, wherein the shaft shank of the rotation shaft has a bottom provided with an abutting stub inserted into the recessed flange of the support base.

9. The safety belt buckle of claim 8, wherein the base unit 1 further includes a ball received in the recessed flange of the support base and located between the recessed flange of the support base and the abutting stub of the shaft shank.

* * * * *